US006643853B2

(12) United States Patent
Wilson et al.

(10) Patent No.: US 6,643,853 B2
(45) Date of Patent: Nov. 11, 2003

(54) AUTOMATICALLY OPERATED HANDLE-TYPE FLUSH VALVE

(75) Inventors: John R. Wilson, Naperville, IL (US); Fatih Guler, Winchester, MA (US)

(73) Assignees: Sloan Valve Company, Franklin Park, IL (US); Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/916,468

(22) Filed: Jul. 27, 2001

(65) Prior Publication Data

US 2003/0019022 A1 Jan. 30, 2003

(51) Int. Cl.[7] ..... E03D 5/00
(52) U.S. Cl. ..... 4/249; 4/DIG. 3; 4/302
(58) Field of Search ..... 4/249, DIG. 3, 4/302, 305, 313; 251/291, 129.11, 129.03, 129.04

(56) References Cited

U.S. PATENT DOCUMENTS

| | | | | |
|---|---|---|---|---|
| 2,999,191 A | * | 9/1961 | Muradian et al. | 4/249 |
| 3,019,453 A | * | 2/1962 | Radcliffe | 4/249 |
| 3,034,151 A | * | 5/1962 | Filliung | 4/249 |
| 3,056,143 A | * | 10/1962 | Foster | 4/DIG. 3 |
| 3,373,449 A | * | 3/1968 | Rusnok | 4/305 |
| 3,778,023 A | | 12/1973 | Billeter | |
| 4,604,735 A | | 8/1986 | Parsons | |
| 4,839,039 A | | 6/1989 | Parsons et al. | |
| 4,921,211 A | | 5/1990 | Novak et al. | |
| 5,125,621 A | | 6/1992 | Parsons et al. | |
| 5,169,118 A | | 12/1992 | Whiteside | |
| 5,195,720 A | | 3/1993 | Nortier et al. | |
| 5,224,685 A | | 7/1993 | Chiang et al. | |
| 5,244,179 A | | 9/1993 | Wilson | |
| 5,251,188 A | | 10/1993 | Parsons et al. | |
| 4,839,039 A | | 2/1994 | Parsons et al. | |
| 5,295,655 A | | 3/1994 | Wilson et al. | |
| 5,313,673 A | | 5/1994 | Saaadi et al. | |
| 5,431,181 A | | 7/1995 | Saadi et al. | |
| 5,456,279 A | | 10/1995 | Parsons et al. | |
| 5,680,879 A | * | 10/1997 | Sheih et al. | 4/DIG. 3 |
| 5,881,993 A | | 3/1999 | Wilson et al. | |
| 5,979,500 A | | 11/1999 | Jahrling et al. | |
| 5,984,262 A | | 11/1999 | Parsons et al. | |
| 6,000,674 A | | 12/1999 | Cheng | |
| 6,056,261 A | * | 5/2000 | Aparicio et al. | |
| 6,127,671 A | | 10/2000 | Parsons et al. | |
| 6,161,726 A | | 12/2000 | Parsons et al. | |
| 6,212,697 B1 | | 4/2001 | Parsons et al. | |
| 6,216,730 B1 | | 4/2001 | Hall | |
| 6,293,516 B1 | | 9/2001 | Parsons et al. | |
| 6,299,127 B1 | | 10/2001 | Wilson | |
| 6,305,662 B1 | | 10/2001 | Parsons et al. | |

FOREIGN PATENT DOCUMENTS

| | | |
|---|---|---|
| TW | 57960 | 12/1996 |
| WO | WO 91/17380 A1 | 11/1991 |
| WO | WO 01/29464 A1 | 4/2001 |

* cited by examiner

*Primary Examiner*—Gregory L. Huson
*Assistant Examiner*—Khoa D. Huynh
(74) *Attorney, Agent, or Firm*—Cook, Alex, McFarron, Manzo, Cummings & Mehler, Ltd.

(57) ABSTRACT

A toilet room flush valve for use in flushing toilets and urinals includes a valve body having a water inlet and a water outlet. There is a valve within the body for controlling flow between the inlet and the outlet. A handle is mounted on the valve body for pivotal movement about a handle axis to operate the valve. There is an assembly mounted on the valve body for causing sensor initiated movement of the handle, which assembly includes a motor driven handle interface pivotally mounted on the valve body for movement about the handle axis and having a portion thereof positioned to contact and pivotally move the handle. A drive motor is mounted on the valve body and connected to the interface to cause pivotal movement thereof. A battery for operating the drive motor is connected to a sensor mounted on the valve body, with the sensor being connected to cause the application of battery power to the drive motor.

17 Claims, 3 Drawing Sheets

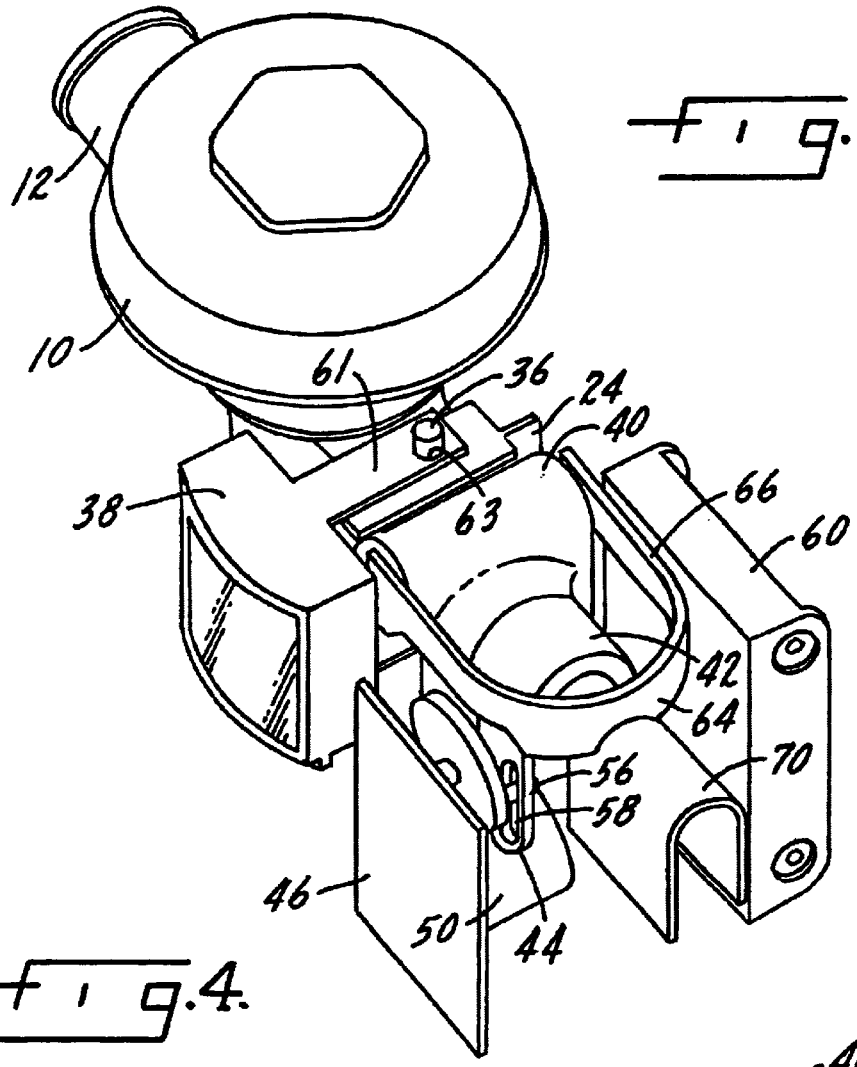
Fig. 3.
Fig. 4.
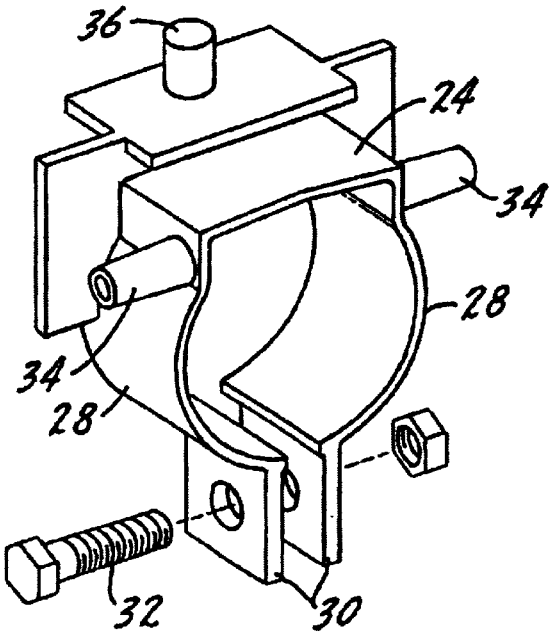
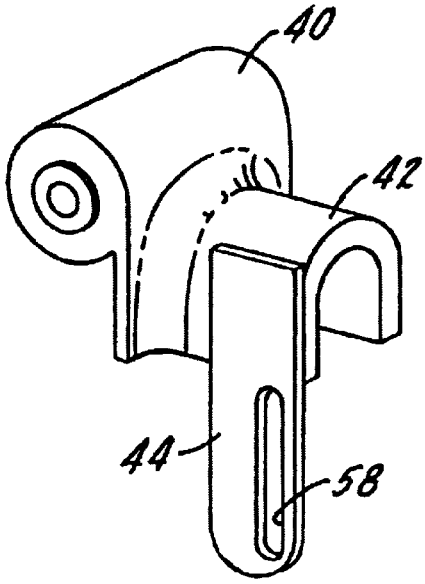
Fig. 5.

AUTOMATICALLY OPERATED HANDLE-TYPE FLUSH VALVE

THE FIELD OF THE INVENTION

The present invention relates to flush valves of the type commonly used to operate toilets and urinals and more specifically to an assembly which converts an existing valve from manual operation to automatic operation. The flush valve may be a diaphragm-type valve, such as that sold by Sloan Valve Company of Franklin Park, Ill., under the trademark ROYAL, and which is shown in U.S. Pat. No. 6,216,730, or it may be a piston-type of flush valve sold by Sloan Valve Company under the trademarks GEM and CROWN and shown for example in U.S. Pat. No. 5,881,993.

The present invention is more specifically directed to a retrofit kit or assembly for a handle-operated flush valve in which the manual handle may be moved by a sensor initiated electric drive motor without replacing or removing any of the flush valve components when installing or converting the flush valve to automatic operation. All of the above types of flush valves have a handle which is mounted on the flush valve body for pivotal movement about a handle axis. The retrofit assembly of the present invention provides a handle interface which mounts over the handle and is movable about the same axis as the handle. A sensor is mounted on the valve body and is attached to a drive motor and when sensor action has been initiated, will connect a battery pack to the drive motor, with the drive motor causing movement of the handle interface. This provides automatic operation of the flush valve by movement of the flush valve handle about its normal or conventional axis. There is further a manual override which is pivotally movable about the same axis, independent of the handle interface, and which may be used to manually operate the handle in the event the automatic system is temporarily inoperative.

Of particular advantage in the invention is the fact that conversion from manual operation to automatic operation can be completed through the mounting of additional components on the existing flush valve and without removing any components of the flush valve or disconnecting the water supply to the flush valve.

SUMMARY OF THE INVENTION

The present invention relates to toilet room flush valves and more specifically to an assembly for converting a valve of this type from manual operation to automatic operation.

A primary purpose of the invention is to provide a conversion assembly as described which may be installed without the removal of any flush valve components and without disconnecting the water supply to the flush valve.

Another purpose of the invention is to provide a conversion assembly of the type described which mounts on the flush valve body, has a handle interface pivotally movable about the flush valve handle axis to cause operation of the flush valve handle when such operation is initiated by an automatic sensor.

Another purpose of the invention is to provide a conversion assembly as described including a manual override which is pivotally movable about the same axis as the flush valve handle and is movable independently of the motor driven handle assembly.

Another purpose is to provide a conversion assembly as described which is suitable for right or left handle operation.

Other purposes will appear in the ensuing specification, drawings and claims.

BRIEF DESCRIPTION OF THE DRAWINGS

The invention is illustrated diagrammatically in the following drawings wherein:

FIG. 3 is a top isometric view of the valve assembly;

FIG. 4 is an isometric view of the mounting bracket for the retrofit unit;

FIG. 5 is an isometric view of the motor drive handle;

DESCRIPTION OF THE PREFERRED EMBODIMENT

Figure 1:
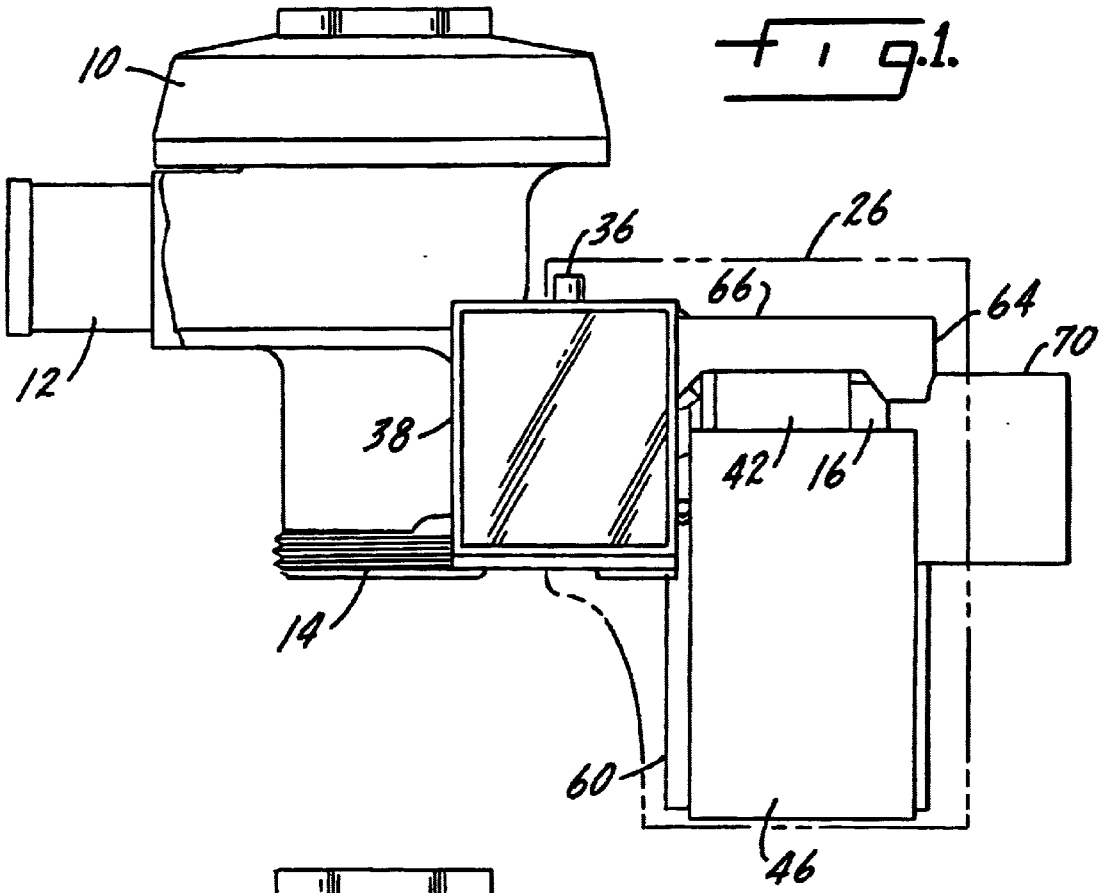
FIG. 1 is a front elevation of the valve assembly.
Figure 2:
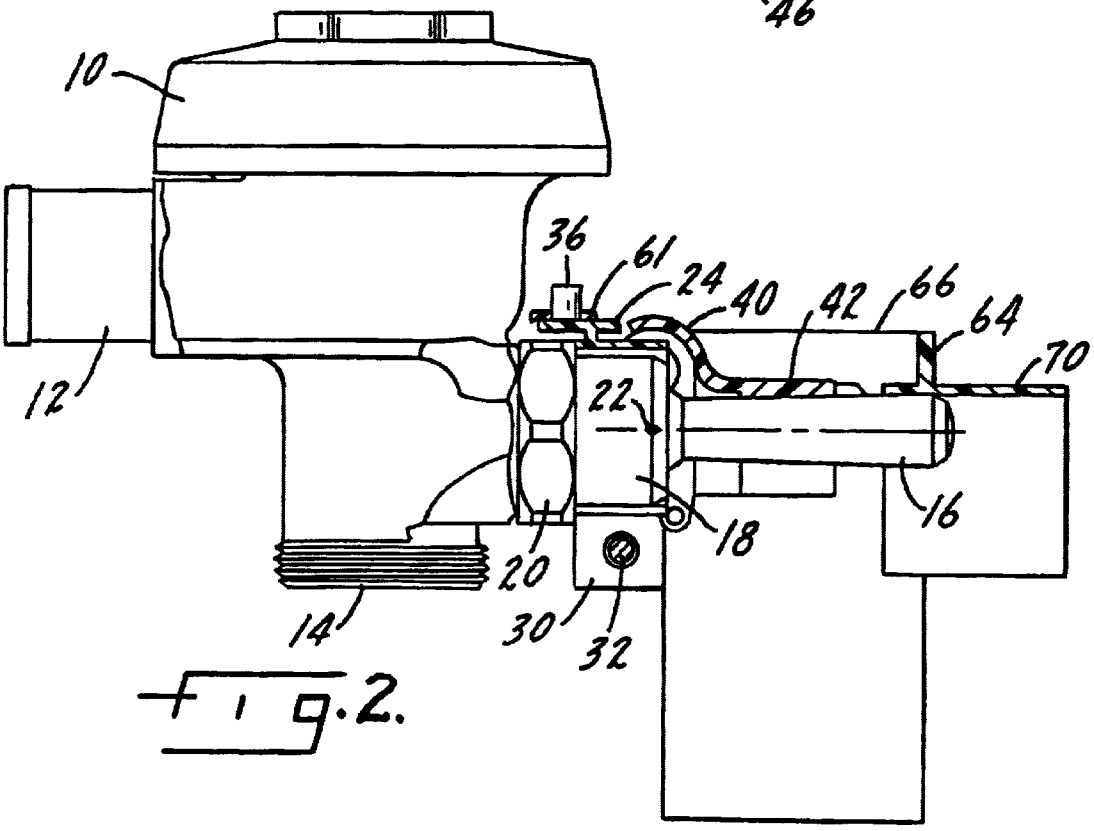
FIG. 2 is a front elevation with portions broken away.
Figure 6:
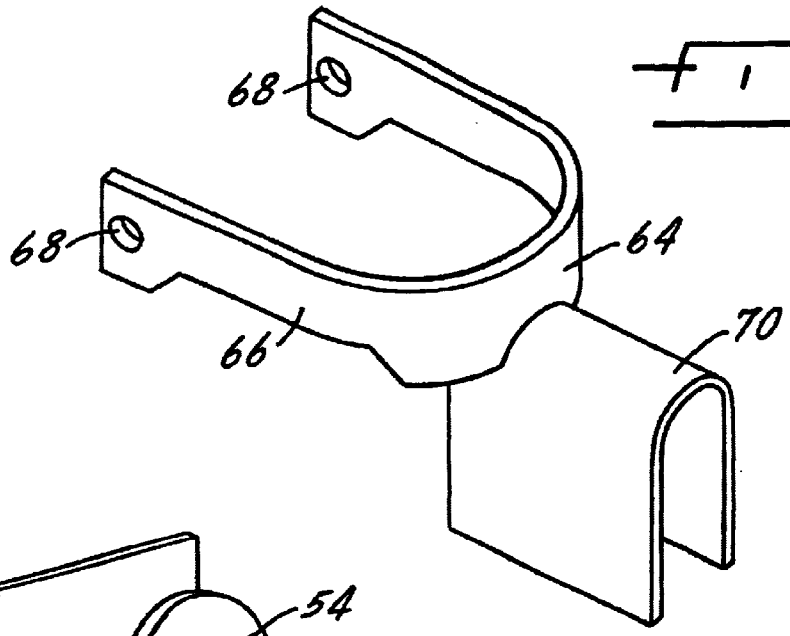
FIG. 6 is an isometric view of the manual override handle.
Figure 7:
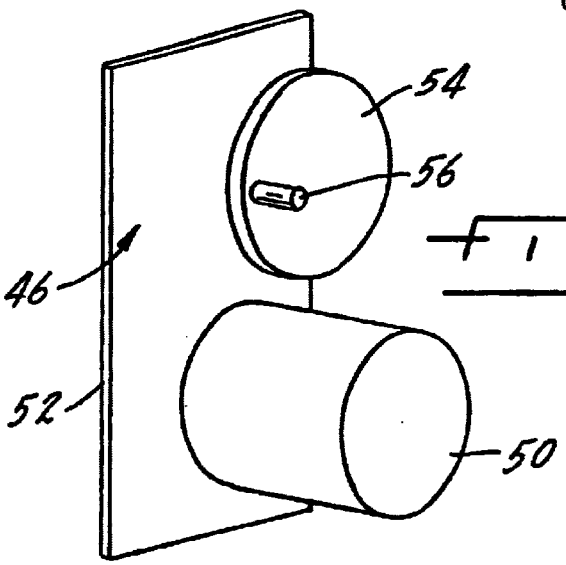
FIG. 7 is an isometric view of the motor drive assembly.

The present invention relates to a conversion assembly for manually-operated toilet room flush valves which may be of the diaphragm type or of the piston type. A diaphragm-type flush valve is shown in U.S. Pat. No. 6,216,730, the disclosure of which is herein incorporated by reference, and is sold by Sloan Valve Company, the assignee of the present application, under the trademark ROYAL. The piston-type flush valve may be of the type shown in U.S. Pat. No. 5,881,993, the disclosure of which is herein incorporated by reference, and may be sold by Sloan Valve Company under the trademarks GEM or CROWN.

The conversion assembly will utilize a sensor, which may be of the infrared type, will be battery powered, and may be as shown in U.S. Pat. No. 6,056,261, also owned by Sloan Valve Company, and the disclosure of which is herein incorporated by reference. Sensor-operated, battery powered flush valves are known in the art from the '261 patent and others. The present invention utilizes the technology in the '261 patent or similar technologies for infrared operation of a flush valve which may be of the types described in the above-referenced patents. The particular disclosure shown herein illustrates a valve of the ROYAL type.

In the drawings, the flush valve body is indicated at 10 and has a water inlet 12 and a water outlet 14. There is a valve, of the diaphragm type, if the valve is of the type sold under the trademark ROYAL, within the body 10 and that diaphragm will control the flow of water between the inlet 12 and the outlet 14.

A manual handle 16 is mounted to the flush valve body 10 by a collar 18 and a coupling nut 20. The handle 16 is pivotally movable about an axis 22 when the handle is normally used to cause operation of the flush valve. The present invention provides an automatic means for moving the otherwise manually operated handle.

The components of the retrofit assembly include a motor mount 24 which is located within a housing 26 and which has a pair of arcuate arms 28 which will clamp about the collar 18. Each of the arms 28 has a bracket portion 30 which will receive a fastener 32 to clamp the arm securely about the collar to install the motor mount. The motor mount 24 has a pair of outwardly-extending pins 34 which, when the motor mount is installed, will be coaxial with the axis 22 for movement of the handle 16. The motor mount further has a upwardly-extending pin 36 which will be used to mount the sensor assembly 38.

Pivotally mounted on the motor mount 24 is a motor drive handle interface 40 which will be mounted on the pins 34 for movement about the handle axis 22. The interface includes a U-shaped cradle 42 which is of a size and shape to accommodate various sizes and types of flush valve handles and, upon pivotal movement of the interface, will cause pivotal movement of the handle 16 about the axis 22. Extending downwardly from the cradle 42 is an arm 44 which will cooperate with the drive motor assembly 46 to cause pivotal movement of the handle interface. It should be noted that the bottom of the cradle 42 is open which will permit downward movement of the handle by a manual override to be described. The handle interface will have bearings spaced on each side of the existing handle, which will prevent sidewise motion of the handle, and will limit the handle to pivotal movement about the axis 22.

Mounted to the housing 26 is the motor drive assembly 46 which will include a drive motor 50 mounted on a drive train 52, the last stage of which is indicated by the gear 54 having a pin 56. The pin 56 will ride in the slot 58 in the handle interface whereby rotation of the gear 54 and the pin 56 will cause pivotal movement of the handle interface to operate the handle 16.

Also mounted in the housing 26 is a sensor assembly 38 which may be of the type shown in the above-referenced patent. The sensor has a bracket 61 with an opening 63. The pin 36 extends through the opening to mount the sensor to the motor mount for either right or left handle operation.

Figure 8:
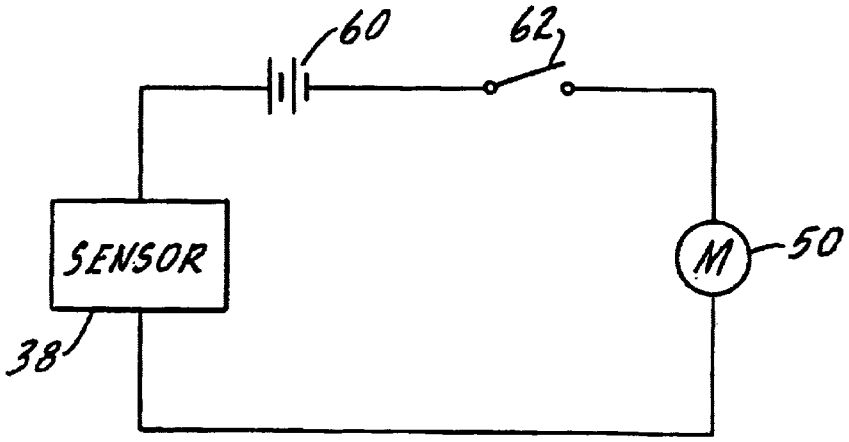
FIG. 8 is a wiring diagram.

There is a battery pack 60 also mounted to the housing 26, with all of the electrical elements being shown in FIG. 8, whereby the sensor 38 is connected to the battery 60 and to the drive motor 50. There is further included a normally closed microswitch 62 which will be operated by movement of the handle to break the circuit between the sensor, drive motor and battery after handle movement is complete and the flush valve has been operated.

The final component in the retrofit assembly is a manual override handle 64 which has an arcuate bracket 66 with a pair of openings 68, with the openings receiving the pins 34 on the motor mount such that the manual override handle will pivotally move about the same axis as the flush valve handle and the handle interface. Thus, all of the components for causing operation of the valve element within the flush valve body move about the same axis. The manual override will only be used in the event automatic operation of the flush valve is not effective. The manual override further includes a yoke 70 which extends over the handle 16 and extends outwardly from the housing 26 whereby it is accessible from the outside of the housing and the retrofit assembly. Movement of the manual override 64 will cause movement of the flush valve handle independently of the handle interface.

Of particular importance in the invention is the fact that the retrofit assembly may be mounted on the flush valve without removing any flush valve components or disconnecting the water supply. The motor mount is fastened onto the collar 18 which mounts the flush valve handle to the valve body. Various other components are mounted in the order shown in the drawings and then the housing 26 will extend over all components with only the manual override handle extending outwardly through the housing for independent operation. The handle interface operates independently of the override handle and the override handle operates independently of the interface. Either component may be used to operate the handle, although the preferred form is for automatic operation to move the handle interface. The override is only used under conditions in which the automatic system is not properly functioning.

Whereas the preferred form of the invention has been shown and described herein, it should be realized that there may be many modifications, substitutions and alterations thereto.

The embodiments of the invention in which an exclusive property or privilege is claimed are as follows:

1. In a toilet room flush valve for use in flushing toilets and urinals includes a valve body having a water inlet and a water outlet, valve means within the body for controlling flow between the inlet and outlet, a handle pivotally mounted on the valve body for movement about a handle axis to operate the valve means, the improvement comprising:

an assembly mounted on the valve body for causing sensor initiated movement of the handle, said assembly including a housing and a motor mount both attached to the valve body, a collar coaxial with said handle, said motor mount being attached directly to said collar, a motor driven handle interface pivotally mounted on the motor mount for movement about the handle axis, and having a portion thereof positioned to contact and pivotally move the handle, a drive motor mounted on the housing and connected to the interface to cause pivotal movement thereof, a battery for operating the drive motor, and a sensor mounted on the motor mount and connected to the drive motor and battery to cause the application of electrical current from the battery to the drive motor.

2. The toilet room flush valve of claim 1 including a manual override handle for causing pivotal movement of the handle independent of the handle interface.

3. The toilet room flush valve of claim 2 wherein the manual override handle is pivotal about the handle axis.

4. The toilet room flush valve of claim 3 wherein pivotal movement of the handle by means of the manual override handle does not cause movement of the handle interface.

5. The toilet room flush valve of claim 1 wherein said motor mount includes a pair of oppositely-directed pins, said pins being coaxial with said handle axis.

6. The toilet room flush valve of claim 5 wherein said handle interface is pivotally mounted on said motor mount pins.

7. The toilet room flush valve of claim 6 further including a manual override handle pivotally mounted on said motor mount pins.

8. A retrofit assembly for conversion of a manually-operated flush valve to automatic operation, without disassembly or removal of any portion of the flush valve, and in which the flush valve includes a valve body having a water inlet and a water outlet, valve means within the body for controlling flow between the inlet and outlet, and a handle mounted on the valve body for pivotal movement about a handle axis to operate the valve means, the assembly including a motor mount attached to the valve body, a collar coaxial with said handle, said motor mount being attached directly to said collar, a motor driven handle interface pivotally mounted on the motor mount for movement about the handle axis and having a portion thereof positioned to contact and pivotally move the handle, a drive motor connected to the handle interface to cause pivotal movement thereof, a battery for operating the drive motor, and a sensor connected to the drive motor and battery to cause application of battery power to the drive motor to cause movement of the handle about the handle axis.

9. The toilet room flush valve of claim 8 including a manual override handle for causing pivotal movement of the valve handle independent of the handle interface.

10. The toilet room flush valve of claim 9 wherein the manual override handle is pivotal about the handle axis.

11. The toilet room flush valve of claim 10 wherein pivotal movement of the handle by means of the manual override handle does not cause movement of the handle interface.

12. The toilet room flush valve of claim 8 wherein said motor mount includes a pair of oppositely-directed pins, said pins being coaxial with said handle axis.

13. The toilet room flush valve of claim 12 wherein said handle interface is pivotally mounted on said motor mount pins.

14. The toilet room flush valve of claim 13 further including a manual override handle pivotally mounted on said motor mount pins.

15. In a toilet room flush valve for use in flushing toilets and urinals includes a valve body having a water inlet and a water outlet, valve means within the body for controlling flow between the inlet and outlet, a handle pivotally mounted on the valve body for movement about a handle axis to operate the valve means, the improvement comprising:

an assembly mounted on the valve body for causing sensor initiated movement of the handle, said assembly including a housing and a motor mount both attached to the valve body, a collar coaxial with said handle, said motor mount being attached directly to said collar, a motor driven handle interface mounted on the motor mount and having a portion thereof positioned to contact and pivotally move the handle, a drive motor mounted on the housing and connected to the handle interface to cause pivotal movement thereof, a battery for operating the drive motor, and a sensor mounted on the motor mount and connected to the drive motor and battery to cause the application of electrical current from the battery to the drive motor.

16. In a toilet room flush valve for use in flushing toilets and urinals includes a valve body having a water inlet and a water outlet, valve means within the body for controlling flow between the inlet and outlet, a handle pivotally mounted on the valve body for movement about a handle axis to operate the valve means, the improvement comprising:

an assembly mounted on the valve body for causing sensor initiated movement of the handle, said assembly including a housing mounted over the handle of the flush valve, a rotatable drive unit mounted to the housing, a motor driven handle interface pivotally mounted to the housing and connected to the drive unit to cause pivotable movement of the handle interface, a portion of the handle interface positioned to contact and pivotally move the handle to permit movement of the handle about the handle axis, a manual override handle pivotally mounted to the housing for movement about an axis which is substantially the same as the handle axis, a battery for operating the drive unit, and a sensor mounted on the housing and connected to the drive unit and battery to cause the application of electrical current from the battery to the drive unit.

17. A retrofit assembly for conversion of a manually-operated flush valve to automatic operation, without disassembly or removal of any portion of the flush valve, and in which the flush valve includes a valve body having a water inlet and a water outlet, valve means within the body for controlling flow between the inlet and outlet, and a handle mounted on the valve body for pivotal movement about a handle axis to operate the valve means, the assembly including a housing attached to the valve body, a motor driven handle interface pivotally mounted to the housing and connected to the drive unit to cause pivotable movement of the handle interface, a portion of the handle interface positioned to contact and pivotally move the handle to permit movement of the handle about the handle axis, a manual override handle pivotally mounted to the housing for movement about an axis which is substantially the same as the handle axis, a battery for operating the drive unit, and a sensor mounted on the housing and connected to the drive unit and battery to cause the application of electrical current from the battery to the drive unit.

* * * * *